US007477276B2

(12) United States Patent
Takahashi

(10) Patent No.: US 7,477,276 B2
(45) Date of Patent: Jan. 13, 2009

(54) THERMAL ACTIVATION DEVICE, PRINTING DEVICE, AND PRINTER

(75) Inventor: Masanori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 140 days.

(21) Appl. No.: 11/515,743

(22) Filed: Sep. 5, 2006

(65) Prior Publication Data

US 2007/0229643 A1 Oct. 4, 2007

(30) Foreign Application Priority Data

Sep. 12, 2005 (JP) ..... 2005-263814
Jun. 23, 2006 (JP) ..... 2006-173744

(51) Int. Cl.
*B41J 2/325* (2006.01)

(52) U.S. Cl. ..... 347/220

(58) Field of Classification Search ..... 347/220, 347/198, 197, 222; 400/120.16, 648, 649
See application file for complete search history.

(56) References Cited

U.S. PATENT DOCUMENTS 6,232,995 B1 * 5/2001 Schartner ..... 347/220
6,249,302 B1 * 6/2001 Sekiya ..... 347/220

FOREIGN PATENT DOCUMENTS

EP 1388421 2/2004
EP 1524193 4/2006

* cited by examiner

*Primary Examiner*—K. Feggins
(74) *Attorney, Agent, or Firm*—Adams & Wilks

(57) ABSTRACT

Thermal activation device, Printing device, and Printer for preventing an insufficient press-contact state of a sheet material relative to a heating means or a printing means, and suppressing an occurrence of thin spot on the sheet material. A thermal activation device including a head support member for supporting a thermal activation head, a support shaft for supporting the head support member in a rotatable manner in a direction allowing the thermal activation head to move toward and away from the platen roller, a platen spring for urging the head support member in a direction in which the thermal activation head is caused to press-contact with the platen roller, a shaft hole in which the support shaft is movably engaged in an urging direction by the platen spring, and an adjustment spring for regulating a position of the support shaft in the shaft hole and urging the head support member in the direction causing the thermal activation head to press-contact with the platen roller.

10 Claims, 7 Drawing Sheets

1

THERMAL ACTIVATION DEVICE, PRINTING DEVICE, AND PRINTER

BACKGROUND OF THE INVENTION

1. Field of the Invention

The present invention relates to a thermal activation device, a printing device, and a printer for conveying, by a platen roller, a sheet material having a print layer on one surface of the sheet material and a heat-sensitive adhesive layer on other surface thereof.

2. Related Background Art

In distribution of goods and stores, for instance, a label indicating various types of information such as prices or bar-code for management use output by a POS (point of sales) terminal is adhered on goods. For this type of label, a label formed of a sheet material including a print layer on one surface of a sheet-like base material and a heat-sensitive adhesive layer on the other surface thereof is proposed.

As a general label issuing device for issuing a label having such a heat-sensitive adhesive layer, an arrangement including a sheet supplying device for supplying a sheet material, a printing device for printing various types of information on a heat-sensitive print layer of the sheet material supplied from the sheet supplying device, a cutting device for cutting the sheet material printed by the printing device, and a thermal activation device for thermally activating the heat-sensitive adhesive layer of the sheet material is disclosed.

As illustrated in FIG. 8, the thermal activation device includes a thermal activation head 111 for thermally activating the heat-sensitive adhesive layer of the sheet material, a platen roller 112 with which the thermal activation head 111 is brought into press-contact, and for holding and conveying the sheet material, and a head support member 113 for supporting the thermal activation head 111.

The platen roller 112 is supported by a platen shaft 118 in a rotatable manner supported by a support frame (not shown), and is driven to rotate by a rotary drive mechanism, not shown. In addition, the head support member 113 is provided with the thermal activation head 111 on one end thereof and a pair of support pieces 119 supported in a rotatable manner by a shaft 114 supported by a support frame. Each of support pieces 119 is provided with a shaft hole 115 into which the shaft 114 is inserted. In addition, a plurality of platen springs 116 for causing the thermal activation head 111 to be in press-contact with a circumference surface of the platen roller 112 is provided on the opposite side of the platen roller 112 across the head support member 113.

With the thermal activation device, a heat-sensitive adhesive layer is thermally activated by the thermal activation head 111 and the sheet material pinched between the thermal activation head 111 and the platen roller 112 is conveyed by the rotation of the platen roller 112 with which the thermal activation head 111 is brought into press-contact.

In addition, although it is not illustrated in the figures, similar to the thermal activation device, the printing device also includes a print head for printing on a heat-sensitive printing layer of the sheet material, a platen roller with which the print head is brought into press-contact for holding and conveying the sheet material, and a head support member for supporting the print head. The head support member is supported, via a support shaft, by a support frame in a rotatable manner and the print head is brought into press-contact with the platen roller by an urging force of a platen spring.

As described above, in a conventional thermal activation device or a printing device, a head support member for supporting a thermal activation head or a print head (hereinafter, simply referred to as a head) is supported by a support frame via a support shaft in a rotatable manner. For this reason, when dimensional accuracy of the head support member or the support frame is not favorably maintained due to manufacturing variation, a platen shaft for supporting a platen roller in a rotatable manner and the support shaft for supporting the head support member in a rotatable manner may not be in parallel to each other in some cases.

In such a case, as illustrated in FIG. 9, the thermal activation head 111 is not brought into contact with the platen roller 112 all over it in an axial direction of the support shaft 114, but is in an uneven contact state in which only one end of the thermal activation head 111 in the axial direction of the shaft 114 is brought into contact with the sheet material.

For this reason, as to the sheet material to be conveyed by the platen roller, only one end of the sheet material in the width direction perpendicular to the conveyance direction may be favorably pressed by the head, however, the other end of the sheet material may not be favorably pressed by the head, resulting in an insufficient pressing force of the head exerted onto the sheet material. That is, a gap is formed between the platen roller and the thermal activation head, and a press-contact state of the sheet material relative to the head becomes insufficient, causing a problem of occurrence of thin spots in the sheet material.

As a measure for solving such problems, a method of correcting uneven contact of the head with respect to the sheet material in a direction of the support shaft, by increasing the press-contact force of the head with the platen roller by increasing the urging force of the platen spring is considered. In some cases, however, the press-contact force may be increased more than necessary due to manufacturing variation, or the press-contact force may not be sufficiently obtained, and thus, it is difficult to sufficiently eliminate uneven contact of the head with respect to the sheet material only by increasing the urging force of the platen spring.

In addition, in the above-described sheet material including the heat-sensitive adhesive layer, a friction coefficient of the heat-sensitive adhesive layer is very large compared to the friction coefficient of the heat-sensitive print layer. For this reason, particularly in the thermal activation device, when conveying the heat-sensitive adhesive sheet, the friction force between the heat-sensitive adhesive layer and the thermal activation head becomes larger than the friction force between the platen roller and the print layer, and so the platen roller is idly rotated relative to the sheet material and therefore it becomes difficult to smoothly convey the sheet material at a predetermined conveyance speed.

For this reason, particularly in the thermal activation device, when the urging force of the platen spring is increased as described above so as to eliminate uneven contact of the thermal activation head with respect to the sheet material, it leads to a problem in which the heat-sensitive adhesive layer of the sheet material is apt to adhere to the thermal activation head. Consequently, in the thermal activation device, the problem of eliminating the uneven contact of the thermal activation head with respect to the sheet material in the direction of the support shaft may not be solved just by increasing the urging force of the platen spring.

SUMMARY OF THE INVENTION

It is an object of the present invention to provide a thermal activation device, a printing device, and a printer, capable of preventing failure of a press-contact state of the sheet material relative to a heating means or a printing means and suppressing occurrence of thin spots in the sheet material.

To solve the above-described problems, a thermal activation device, according to the present invention, comprises heating means including a heating element for thermally activating a heat-sensitive adhesive layer of a sheet material having a print layer on one surface of a sheet-like base material and the heat-sensitive adhesive layer on the other surface thereof, a platen roller with which the heating means is brought into press-contact for holding and conveying the sheet material, a-support member for supporting the heating means, a support shaft for supporting the support member in a rotatable manner in a direction allowing the heating means to move toward and away from the platen roller, a first urging member for urging the support member in a direction causing the heating means to press-contact the platen roller, a shaft hole in which the support shaft is movably engaged in an urging direction by the first urging member, and a second urging member for regulating a position of the support shaft in the shaft hole and urging the support member in a direction causing the heating means to press-contact the platen roller, wherein an urging force of the second urging member is set to be smaller than the urging force of the first urging member.

With the thermal activation device according to the present invention having the configuration as described above, upon occurrence of uneven contact of the heating means with respect to the platen roller in the direction of the support shaft, the support member is moved relative to the platen roller by the urging force of the first urging member and the second urging member, and the support shaft is moved in the shaft hole in the urging direction by the first urging member, and so uneven contact of the heating means with respect to the sheet material in the direction of the support shaft is adjusted.

In addition, the shaft hole provided in another thermal activation device according to the present invention may be formed in an elongate shape along a circumference direction of a circle having its center at the heating element. With this configuration, even when the support shaft is moved in the shaft hole, the distance between the heating element and the support shaft is maintained constantly, and therefore, the position of the heating element relative to the platen roller does not change.

In addition, a printing device, according to the present invention, comprises printing means including a heating element for printing on a heat-sensitive print layer of a sheet material having the heat-sensitive print layer on one surface of a sheet-like base material and a heat-sensitive adhesive layer on the other surface thereof, a platen roller with which the printing means is brought into contact for holding and conveying the sheet material, a support member for supporting the printing means, a support shaft for supporting the support member in a rotatable manner in a direction allowing the printing means to move toward and away from the platen roller, a first urging member for urging the support member in a direction causing the printing means to press-contact with the platen roller, a shaft hole in which the support shaft is movably engaged in an urging direction by the first urging member, and a second urging member for regulating a position of the support shaft in the shaft hole and urging the support member in a direction causing the printing means to press-contact the platen roller, wherein an urging force of the second urging member is set to be smaller than urging force of the first urging member.

In addition, a printer, according to the present invention, comprises the above-described thermal activation device and the printing device for heating and printing the print layer, wherein the sheet material is conveyed through the thermal activation device and the printing device.

As described above, according to the present invention, with the support member being moved relative to the platen roller according to the urging state of the support member relative to the platen roller in a direction of the support shaft, it is possible to favorably bring the heating means or the printing means into press-contact with respect to the platen roller in the direction of the support shaft, and accordingly, a press-contact state of the sheet material with respect to the heating means or the printing means is prevented from becoming insufficient, and thus an occurrence of thin spots in the sheet material is suppressed.

DETAILED DESCRIPTION OF THE PREFERRED EMBODIMENTS

Specific embodiments of the present invention are described below with reference to the figures.

A label issuing device used for issuing a label to be attached to an article for displaying various types of information is briefly described.

Figure 1:
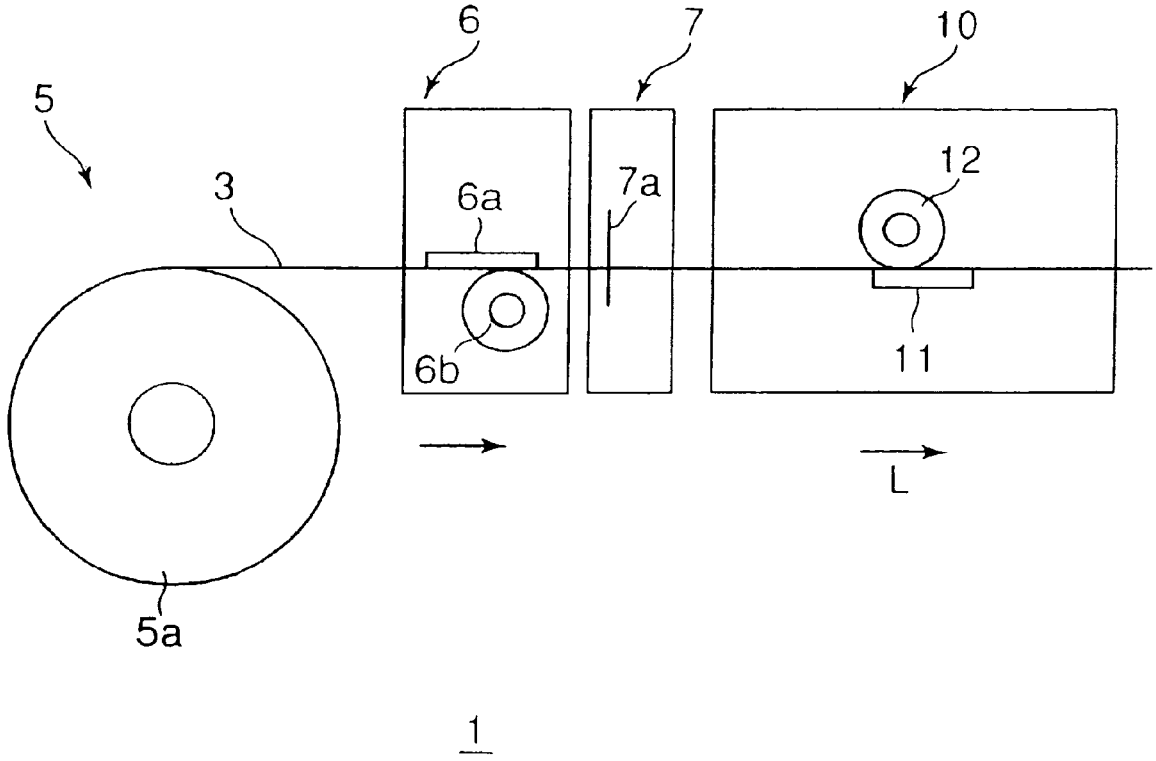
FIG. 1 is a cross-sectional view illustrating a label issuing device according to an embodiment of the present invention.

As illustrated in FIG. 1, a label issuing device 1 includes, along a conveyance path of a sheet material 3 in a direction indicated by an arrow L in FIG. 1, a sheet supplying device 5 for supplying a sheet material 3, a printing device 6 for printing various types of information on a heat-sensitive print layer of the sheet material 3, a cutting device 7 for cutting the sheet material 3 printed by the printing device 6, and a thermal activation device 10 for thermally activating a heat-sensitive adhesive layer of the sheet material 3, which are provided in the stated order.

The sheet supplying device 5 includes a sheet roll 5*a* around which the sheet material 3 is wound, and supplies the sheet material 3 by rolling out the sheet roll 5*a*. Although it is not shown, the sheet material 3 supplied from the sheet supplying device 5 includes a sheet-like base material, the heat-sensitive print layer formed on the surface side of the sheet-like base material, and the heat-sensitive adhesive layer formed on the rear surface side of the sheet-like base material. It is to be noted that, according to need, a sheet material including a heat-insulating layer for shielding heat transmission from one layer side of the sheet-like base material to another layer side thereof and provided between the sheet-like base material and the heat-sensitive print layer may be used.

A so-called thermal printer including a heating element is used for the printing device 6. The printing device 6 includes a thermal head 6*a* for causing the heat-sensitive print layer of the sheet material 3 to become heat-sensitive and a platen roller 6*b* which is brought into press-contact with the thermal head 6*a*. The printing device 6 pinches the sheet material 3 supplied from the sheet supplying device 5 between the thermal head 6*a* and the platen roller 6*b* so as to perform printing and convey the sheet material. The cutting device 7 includes a cutter 7*a* for cutting the sheet material 3 discharged from the printing device 6 into a desired length, and discharges the thus cut sheet material 3 to the thermal activation device 10.

Figure 2:
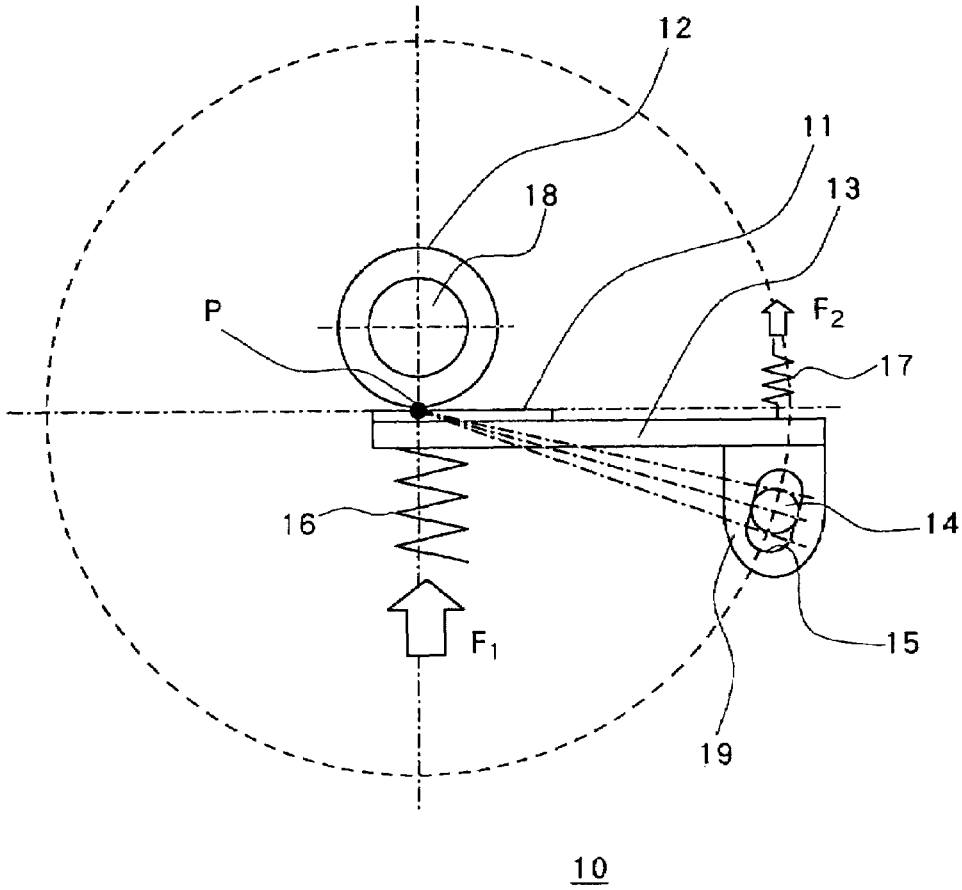
FIG. 2 is a side view illustrating a thermal activation device.
Figure 3:
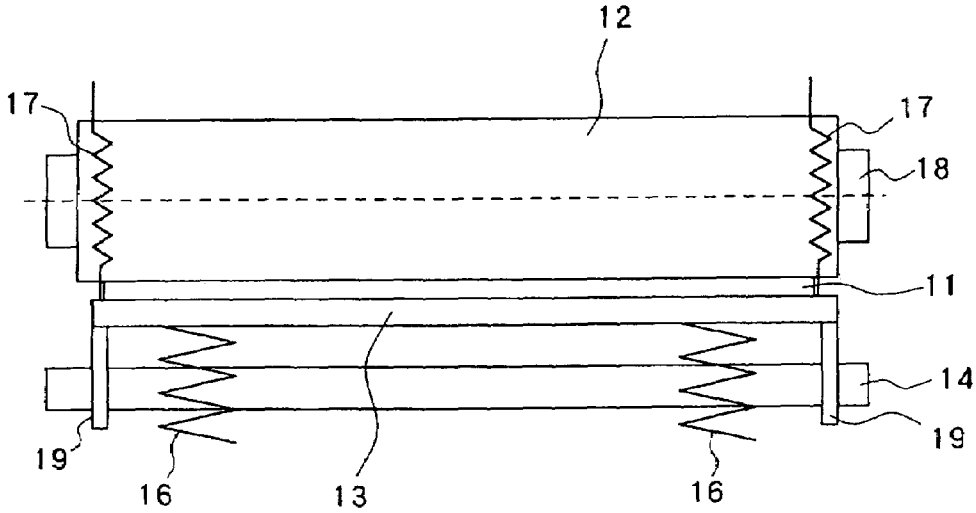
FIG. 3 is a front elevation view illustrating a contact state of a platen roller and a thermal activation head in a direction of a support shaft.

As illustrated in FIGS. 2 and 3, the thermal activation device 10 includes a thermal activation head 11 for thermally activating the heat-sensitive adhesive layer of the sheet material 3, a platen roller 12 with which the thermal activation head 11 is brought into press-contact for conveying the sheet material 3 in a conveyance direction being a direction indicated by the arrow L while the sheet material 3 is pinched between the thermal activation head 11 and the platen roller 12, a head support member 13 for supporting the thermal activation head 11, and a support shaft 14 for supporting the head support member 13 in a rotatable manner in a direction allowing the thermal activation head 11 to move toward and away from the platen roller 12.

The thermal activation device 10 also includes a shaft hole 15 provided in the head support member 13 and into which the support shaft 14 is movably inserted in the urging direction by platen springs 16 and adjustment springs 17, described later, a plurality of platen springs 16 serving as a first urging member for urging the head support member 13 in a direction causing the thermal activation head 11 to press-contact the platen roller 12, and a set of adjustment springs 17 serving as a second urging member for regulating a position of the support shaft 14 in the shaft hole 15 and urging the head support member 13 in the direction causing the thermal activation head 11 to press-contact with the platen roller 12.

As the thermal activation head 11, a thermal head similar to the thermal head 6*a* provided on the printing device 6 is used, which includes a plurality of heating elements (heating bodies), not shown, arranged along a width direction of the sheet material 3 perpendicular to the conveyance direction of the sheet material 3. The thermal activation head 11 is capable of thermally activating the heat-sensitive adhesive layer per dot unit in the width direction of the sheet material 3, which is achieved by selectively heating arbitrary heating elements. Further, the thermal activation head 11 is brought into press-contact with a circumference surface of the platen roller 12 by respective urging forces of the platen springs 16 and the adjustment springs 17.

The platen roller 12 is supported by a platen shaft 18 in a rotatable manner, and is driven to rotate by a rotary drive mechanism, not shown. Both ends of the platen shaft 18 are supported by a support frame (not shown). It is to be noted that since the sheet material may be conveyed smoothly by the platen roller when the friction force between the platen roller and the heat-sensitive print layer of the sheet material is greater than the friction force between the heat-sensitive adhesive layer of the sheet material and the thermal activation head, the platen roller may be formed of a material having a relatively high friction coefficient such as a resin material including fluorosilicone rubber.

The head support member 13 is formed in a substantially flat plate-like shape, and the thermal activation head 11 is provided on one end side of the head support member 13 in the sheet conveyance direction of the sheet material 3. In addition, a set of support pieces 19 which are supported by the support shaft 14 in a rotatable manner is provided on the other end side of the head support member 13. A shaft hole 15 into which the support shaft 14 is inserted is formed in each support piece 19. In addition, both ends of the support shaft 14 inserted through the shaft holes 15 of respective support pieces 19 are supported by a support frame. Further, the heating elements of the thermal activation head 11 are arranged on the head support member 13 at a position slightly displaced from the position of contact point P where the platen roller 12 and the head support member 13 are brought into contact with each other by a predetermined offset amount toward the conveyance direction of the sheet material 3.

As illustrated in FIG. 2, the shaft hole 15 is formed along the circumference of a circle having its center at the heating elements of the thermal activation head 11, as viewed from the end surface of the platen roller 12. For this reason, when the support shaft 14 is moved in and along the shaft hole 15, the distance between the heating elements of the thermal activation head 11 and the support shaft 14 is maintained constantly, and therefore, the position of the thermal activation head 11 relative to the platen roller 12 does not change regardless of the position of the support shaft 14 in the shaft hole 15. In other words, the offset amount of the thermal activation head 11 relative to the platen roller 12 is constantly maintained.

A compression coil spring is used as the platen spring 16, and is arranged at a position where it presses the head support member 13 from the opposite side of the platen roller 12 across the head support member 13. One end of each of the platen springs 16 comes into contact with the head support member 13 and the other end thereof is supported by the support frame, and the platen springs 16 press the thermal activation head 11 relative to the platen roller 12.

A tension coil spring is used as the adjustment spring 17, and is arranged at a position where it pulls the support pieces 19 of the head support member 13 from the opposite side of the platen spring 16 relative to the head support member 13. Each of the adjustment springs 17 is provided adjacent to the support pieces 19 of the head support member 13 such that one end of each of the adjustment springs 17 is latched to each of the support pieces 19 and the other end of each of the adjustment springs 17 is latched to the support frame.

With the support pieces 19 of the head support member 13 being urged by the adjustment springs 17, the support shaft 14 is maintained at a predetermined position in the shaft hole 15. Thus, the head support member 13 is designed to smoothly rotate in a direction allowing the thermal activation head 11 to move toward and away from the platen roller 12, with the support shaft 14 serving as a rotational fulcrum.

Urging force $F_2$ of the adjustment springs is set to be smaller than the urging force $F_1$ of the platen springs 16. Thus, the head support member 13 is designed to be movable relative to the platen roller 12 by the urging force of the platen springs 16 and the adjustment springs 17. Along with the movement of the head support member 13 relative to the platen roller 12, the support shaft 14 moves along the shaft hole 15. Thus the head support member 13 is adjustably moved relative to the platen roller 12 and uneven contact of the thermal activation head 11 with respect to the sheet material 3 in a direction of the support shaft 14 is adjusted, accordingly.

Regarding the thermal activation device 10 having the above-described configuration, the operation of adjusting a contact state of the thermal activation head 11 relative to the sheet material 3 in the direction of support shaft 14 is described as follows.

In the thermal activation device 10, when uneven contact of the thermal activation head 11 with respect to the platen roller 12 in the direction of the support shaft 14 occurs due to manufacturing variation in the support frame, the head support member 13, and so forth, the head support member 13 moves relative to the platen roller 12 by the urging force of the platen springs 16 and the adjustment springs 17, and each end portion of the support shaft 14 moves along each shaft hole 15.

For this reason, a position of the head support member 13 relative to the platen roller 12 in the direction of support shaft 14 is moved and the thermal activation head 11 is favorably brought into press-contact with the circumference surface of the platen roller 12 in the direction of the support shaft 14. In other words, in the thermal activation device 10, uneven contact of the thermal activation head 11 with respect to the platen roller 12 occurring in the direction of the support shaft 14 is autonomously corrected. For this reason, a press-contact state of the sheet material 3 with respect to the thermal activation head 11 is prevented from becoming insufficient.

As described above, according to the thermal activation device 10 provided with the head support member 13 including the shaft hole 15 having the elongated shape into which the support shaft 14 is movably inserted and the adjustment springs 17 exerting the urging force smaller than the urging force of the platen springs 16, the head support member 13 is autonomously moved and adjusted relative to the platen roller 12 according to a press-contact state of the platen roller 12 with respect to the thermal activation head 11 in the direction of the support shaft 14. For this reason, according to the thermal activation device 10, uneven contact of the thermal activation head 11 with respect to the platen roller 12 to occur in the direction of the support shaft 14 is adjusted, the thermal activation head 11 can be brought into favorably press-contact with the sheet material 3 in the direction of the support shaft 14, the press-contact state of the sheet material 3 with respect to the thermal activation head 11 is prevented from becoming insufficient, and an occurrence of thin spots in the sheet material 3 can be suppressed.

Thus, with the thermal activation device 10, even when dimensional accuracy of the support frame, the head support member 13, and so forth, is not sufficiently maintained, an offset amount of the thermal activation head 11 relative to the platen roller 12 can be constantly maintained, and the uneven contact of the thermal activation head 11 with respect to the sheet material 3 in the direction of the support shaft 14 can be easily eliminated.

Explained in the above-described embodiment is the thermal head activation device configured to use compression coil springs as the platen springs 16 for urging the head support member 13 in the direction in which the thermal activation head 11 is brought into press-contact with the platen roller 12 and tension coil springs are used as a set of the adjustment springs for urging the head support member 13 in the direction in which the thermal activation head 11 is brought into press-contact with the platen roller 12 by regulating the position of the support shaft 14 in the shaft hole 15. The present invention, however, is not limited to this configuration, but any urging member such as a plate spring, a torsion coil spring, or an elastic member can be used as the urging member as long as the urging member causes the thermal activation head 11 to press-contact the platen roller 12. Other embodiments using other urging members as the platen springs 16 or the adjustment springs 17 are explained as follows.

Other Embodiments

As illustrated in FIGS. 4A-4D, in the above-described embodiment, the constitution in which the support pieces 19 of the head support member 13 are pulled by the tension coil spring serving as the adjustment spring 17 is adopted, however, the constitution in which the head support member 13 can be pressed by the adjustment spring 17 can be adopted. Other embodiment adopting a configuration in which the head support member 13 is pressed by the adjustment spring 17 is explained as follows with reference to FIGS. 4A to 4D.

Figure 4A:
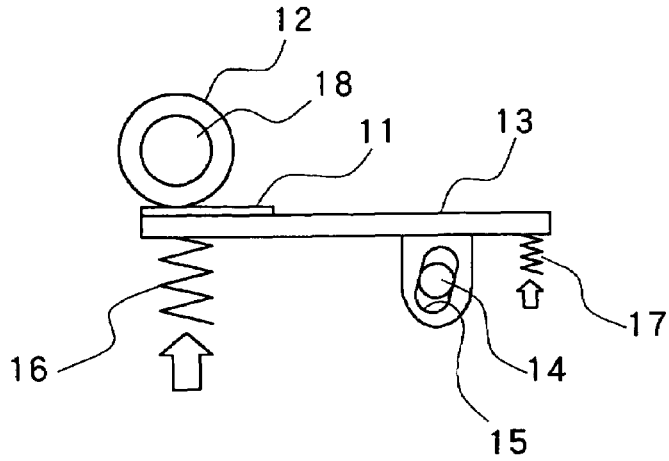
FIGS. 4A-4D are side views illustrating various types of configurations using other springs as adjustment springs.
Figure 4B:
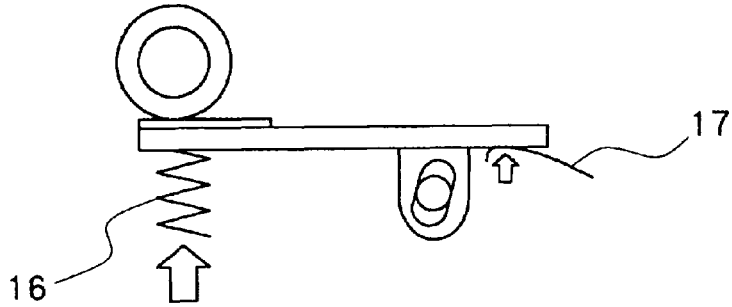

In the other embodiments, a compression coil spring is used as the platen spring 16; a compression coil spring can be used as the adjustment spring 17 as illustrated in FIG. 4A, and a plate spring can be used as the adjustment spring 17 as illustrated in FIG. 4B. One end of the plate spring is secured and the other end thereof is brought into contact with the head support member 13.

Figure 4C:
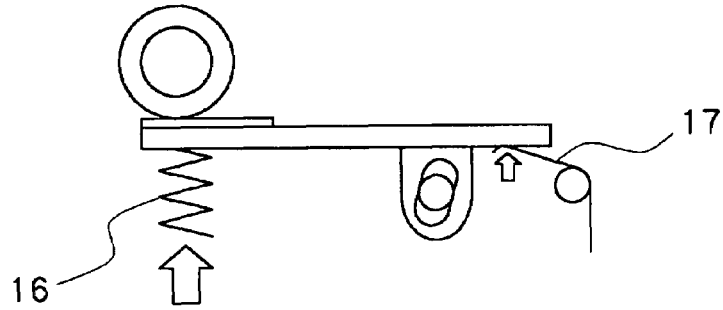
Figure 4D:
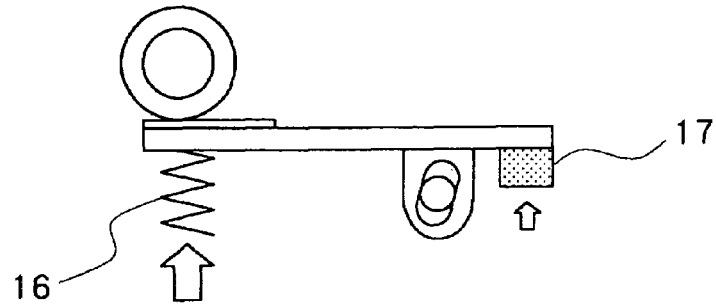

Likewise, in other embodiments, a compression coil spring is used as the platen spring 16; a torsion coil spring can be used as the adjustment spring 17 as illustrated in FIG. 4C, and n elastic member can be used as the adjustment spring 17 as illustrated in FIG. 4D. In these configurations, the torsion coil spring is supported by a support shaft (not shown), with one end of the torsion coil spring brought into contact with a secured part (not shown) and other end thereof is brought into contact with the support member 13. For instance, the elastic member is formed of a rubber material or a porous material, and is brought into contact with the head support member 13 in a state of being elastically deformed. In other words, the elastic member is provided in such a manner as to press the head support member 13 with the elastic force.

Next, other embodiments in which a plate spring is used as the platen spring 16 is briefly explained as follows with reference to FIGS. 5A to 5E.

Figure 5A:
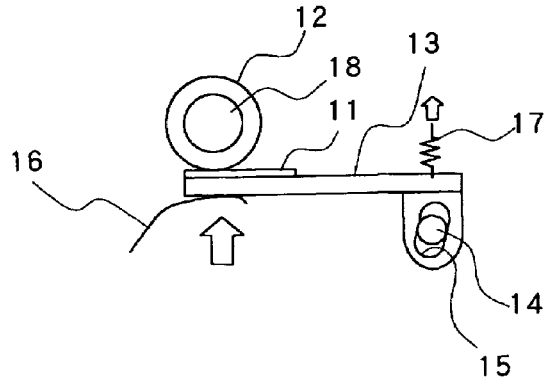
FIGS. 5A-5E are side views illustrating various types of configurations using a plate spring as platen springs.
Figure 5B:
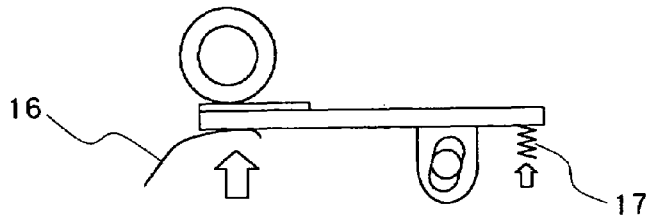
Figure 5C:
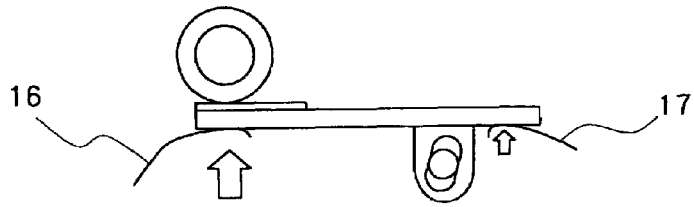

In the other embodiments, a tension coil spring is used as the adjustment spring 17 and, as illustrated in FIG. 5A, a plate spring can be used as the platen spring 16. In addition, in further other embodiment, a plate spring is used as the platen spring 16; a compression coil spring can be used as the adjustment spring 17 as illustrated in FIG. 5B, and a plate spring can be used as the adjustment spring 17 as illustrated in FIG. 5C.

Figure 5D:
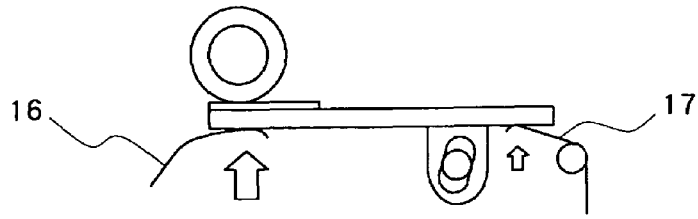
Figure 5E:
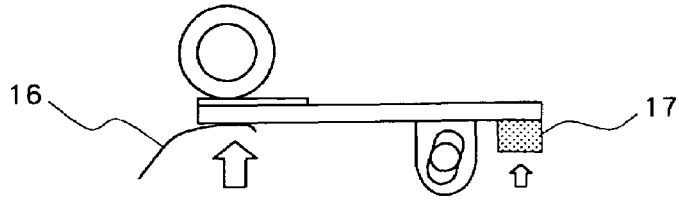

Likewise, in further other embodiment, a plate spring is used as the platen spring 16; a torsion coil spring can be used as the adjustment spring 17 as illustrated in FIG. 5D, and an elastic member can be used as the adjustment spring 17 as illustrated in FIG. 5E.

Figure 6:
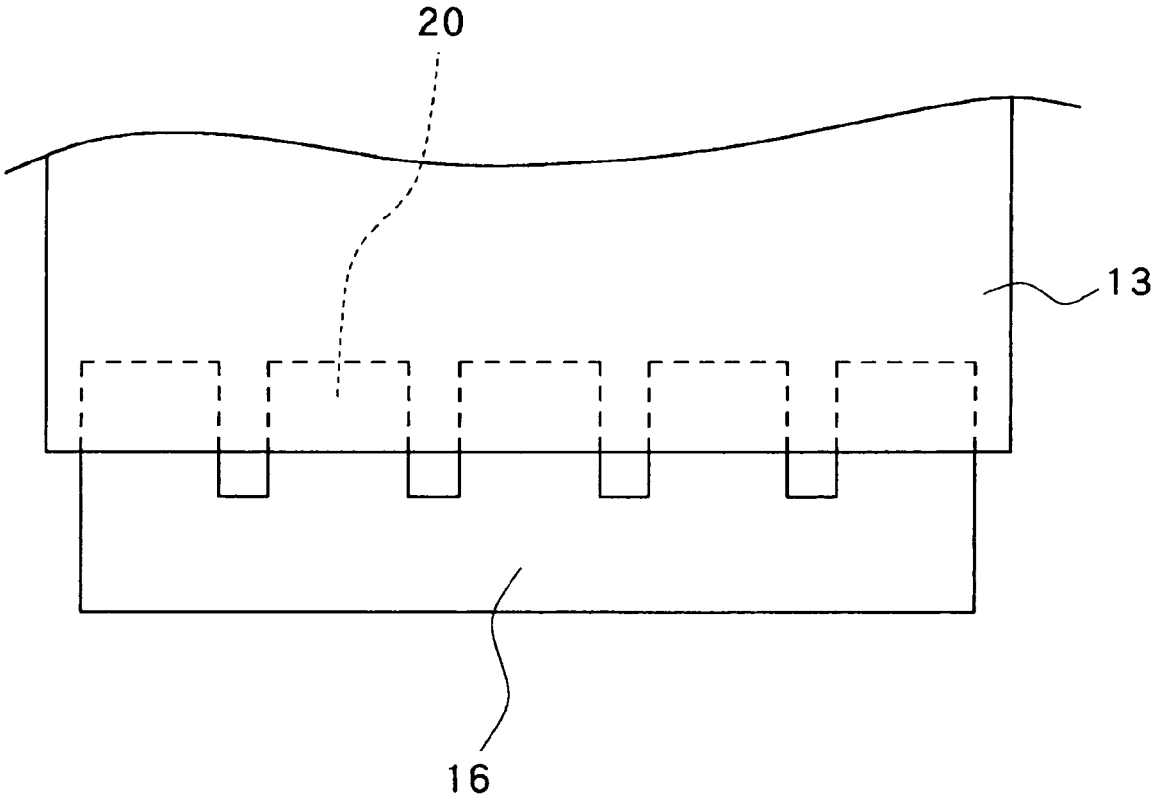
FIG. 6 is a plan view illustrating a shape of the plate spring.

As illustrated in FIG. 6, the plate spring used as the platen spring 16 and the adjustment spring 17 is formed of a metal material, for instance, and one side of the plate spring brought into contact with the head support member 13 is chipped at predetermined intervals to form a comb shape, forming a plurality of elastic pieces 20. According to the plate spring thus configured, the pressing force of the plate spring can be easily controlled by appropriately adjusting the size of the elastic pieces 20. Thus the thermal activation head 11 can be favorably pressed against the platen roller 12.

In other words, for instance, the plate spring can be arranged such that the elastic force of the plate spring can be adjusted by appropriately changing the number of the elastic pieces 20 by changing the length from the base part to the edge of the elastic pieces 20, increasing or reducing the width of the elastic pieces 20, and increasing or reducing an interval (pitch) between the elastic pieces 20. In addition, it is preferable to configure each of the elastic pieces 20 comes into contact with the head support member 13 such that pressing force of each of the elastic pieces 20 is evenly applied relative to the width direction of the head support member 13 (in the axial direction of the platen roller 12) to be pressed by the plate spring. In this case, for instance, the plate spring is configured such that the plurality of elastic pieces 20 is arranged at even intervals relative to the width direction of the head support member 13 or axisymmetrically with respect to the center line relative to the width direction of the head support member 13. In addition, the plate spring can be made of a resin material such as plastic, however, taking a change in the elastic force caused due to effect of heat of the thermal activation head 11, it is preferable that the plate spring is made of a metal material which is relatively less affected by heat.

Finally, other embodiments using a torsion coil spring as the platen spring 16 is briefly explained with reference to FIGS. 7A to 7E.

Figure 7A:
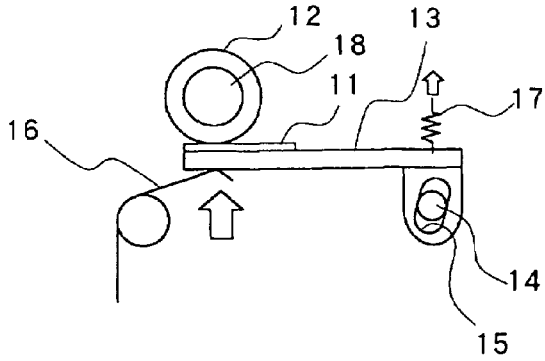
FIGS. 7A-7E are side views illustrating various types of configurations using a torsion coil spring as the platen springs.
Figure 7B:
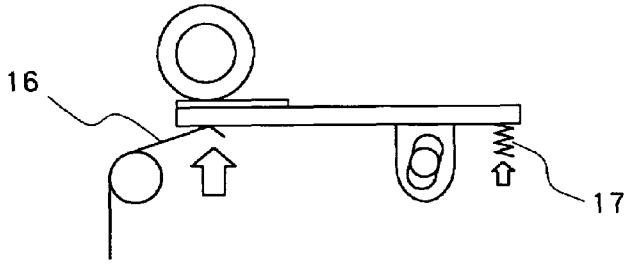
Figure 7C:
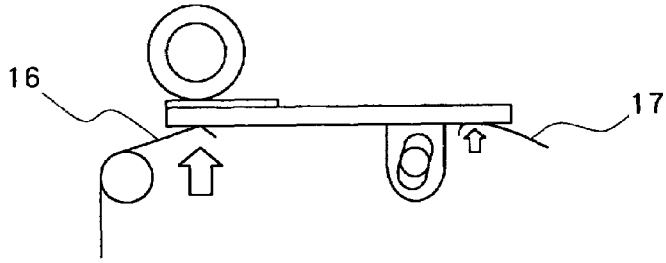

In other embodiment, a tension coil spring is used as the adjustment spring 17 and a torsion coil spring can be used as the platen spring 16 as illustrated in FIG. 7A. In addition, in other embodiment, a torsion coil spring is used as the platen spring 16; a compression coil spring can be used as the adjustment spring 17 as illustrated in FIG. 7B, and a plate spring can be used as the adjustment spring 17 as illustrated in FIG. 7C.

Figure 7D:
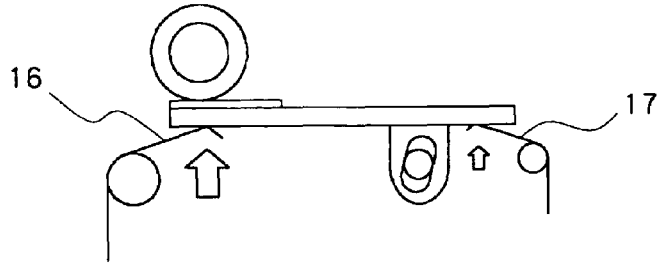
Figure 7E:
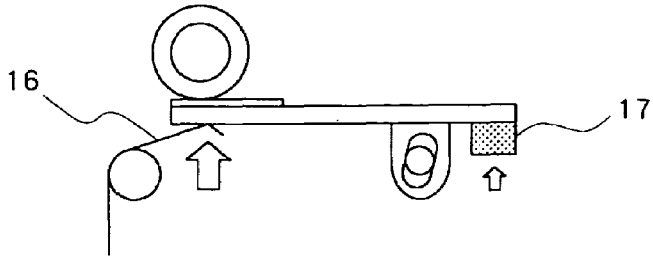
Figure 8:
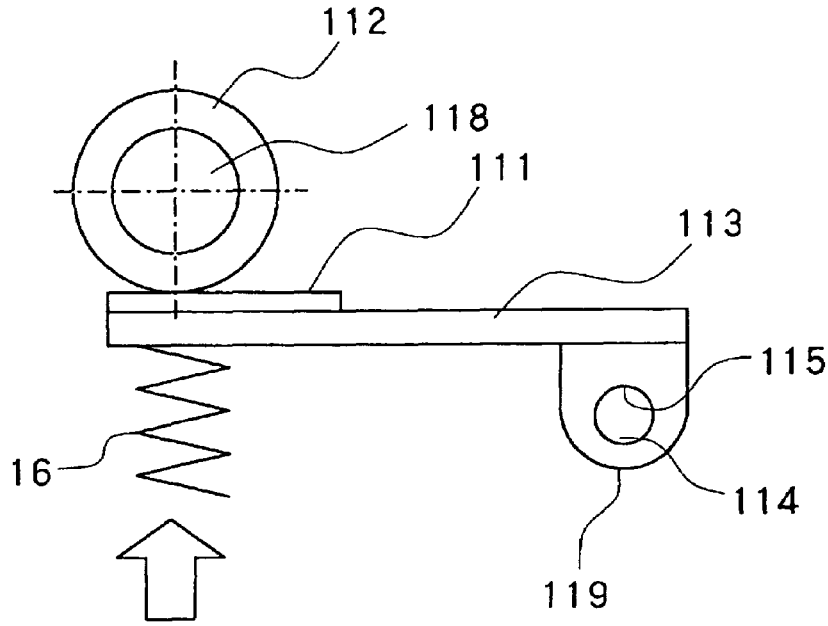
FIG. 8 PRIOR ART
FIG. 8 is a side view illustrating a conventional thermal activation device.
Figure 9:
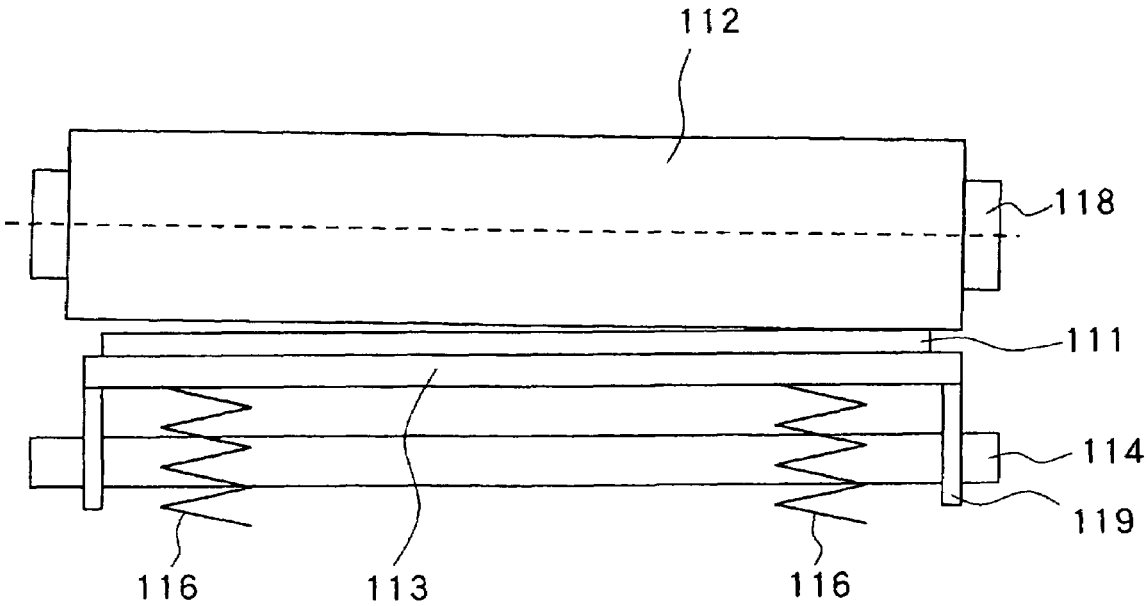
FIG. 9 PRIOR ART
FIG. 9 is a front elevation view illustrating a contact state of a platen roller and a thermal activation head in the direction of the support shaft in the conventional thermal activation device.

Likewise, in other embodiments, a torsion coil spring is used as the platen spring 16; a torsion coil spring can be used as the adjustment spring 17 as illustrated in FIG. 7D, and an elastic member can be used as the adjustment spring 17 as illustrated in FIG. 7E.

As described above, the platen spring 16 and the adjustment spring 17 can be comprised of the combinations of various types of springs and elastic members, as needed, and a similar effect can be achieved. In addition, when taking downsizing of the thermal activation device into consideration, it is preferable that the thermal activation device is configured to use a compression coil spring or a plate spring as the platen spring and a tension coil spring, a compression coil spring, a torsion coil spring, or a plate spring as the adjustment spring.

In the above-described embodiments, the thermal activation device is configured to control uneven contact of a thermal activation head with respect to a platen roller, however, a similar effect is achieved when the thermal activation device is used in a printing device to control uneven contact of a print head with respect to the platen roller.

In addition, the thermal activation device described in the above embodiments has a configuration such that the shaft hole into which the support shaft is inserted is formed along the circumference of a circle having its center at heating elements, however, the configuration may be such that the shaft hole is formed in a circular shape having an inner diameter larger than an outer diameter of the support shaft, and the support shaft is inserted into the shaft hole in a movable manner in an urging direction by the platen spring and the adjustment spring. In this case also, a similar effect as described above may be achieved.

In addition, the thermal activation device described in the above embodiments has a configuration such that the shaft hole into which the support shaft is inserted is formed in the support pieces of the head support member, however, although it is not shown, the configuration may be such that, the shaft hole is provided in the support frame, and the support shaft may be secured to the head support member. In this case also, similar effect as described above may be achieved.

What is claimed is:

1. A thermal activation device comprising:

heating means including a heating element for thermally activating a heat-sensitive adhesive layer of a sheet material having a print layer on one surface of a sheet-like base material and the heat-sensitive adhesive layer on the other surface thereof;

a platen roller with which the heating means is brought into press-contact for holding and conveying the sheet material;

a support member for supporting the heating means;

a support shaft for supporting the support member in a rotatable manner in a direction allowing the heating means to move toward and away from the platen roller;

a first urging member for urging the support member in a direction causing the heating means to press-contact the platen roller;

a shaft hole in which the support shaft is movably engaged in an urging direction by the first urging member; and a second urging member for regulating a position of the support shaft in the shaft hole and urging the support member in a direction causing the heating means to press-contact the platen roller, wherein an urging force of the second urging member is set to be smaller than the urging force of the first urging member.

2. The thermal activation device according to claim 1, wherein the heating means is provided on one end of the support member and the shaft hole is provided on the other end of the support member.

3. The thermal activation device according to claim 1, wherein the shaft hole is formed in an elongated shape along a circumference of a circle having its center at the heating element.

4. The thermal activation device according to claim 1, wherein the first urging member is arranged at a position where it presses one end of the support member from a side opposite to the platen roller across the support member, and the second urging member is arranged at a position where it pulls the other end of the support member from a side opposite to the first urging member relative to the support member.

5. The thermal activation device according to claim 4, wherein the first urging member is any one of a compression coil spring, a plate spring and a torsion coil spring; and the second urging member is a tension coil spring.

6. The thermal activation device according to claim 1, wherein the first urging member is arranged at a position where it presses one end of the support member from a side opposite to the platen roller across the support member, and the second urging member is arranged at a position where it presses the other end of the support member from the same side as the first urging member relative to the support member.

7. The thermal activation device according to claim 6, wherein the second urging member is any one of a compression coil spring, a plate spring and a torsion coil spring.

8. The thermal activation device according to claim 6, wherein the second urging member is any one of a compression coil spring, a plate spring and a torsion coil spring.

9. A printer comprising the thermal activation device according to claim 1 and the printing device for heating and printing the print layer, wherein the sheet material is conveyed through the thermal activation device and the printing device.

10. A printing device comprising:

printing means including a heating element for printing on a heat-sensitive print layer of a sheet material having the heat-sensitive print layer on one surface of a sheet-like base material and a heat-sensitive adhesive layer on the other surface thereof;

a platen roller with which the printing means is brought into contact for holding and conveying the sheet material;

a support member for supporting the printing means;

a support shaft for supporting the support member in a rotatable manner in a direction allowing the printing means to move toward and away from the platen roller;

a first urging member for urging the support member in a direction causing the printing means to be in press-contact with the platen roller;

a shaft hole in which the support shaft is movably engaged in an urging direction by the first urging member; and a second urging member for regulating a position of the support shaft in the shaft hole and urging the support member in a direction causing the printing means to be in press-contact with the platen roller, wherein an urging force of the second urging member is set to be smaller than the urging force of the first urging member.

* * * * *